US006464519B1

(12) United States Patent
Hawks

(10) Patent No.: US 6,464,519 B1
(45) Date of Patent: Oct. 15, 2002

(54) ELECTRICAL EXTENSION CORD WITH CONVERTIBLE PLUG AND ACCOMMODATING RECEPTACLE

(76) Inventor: Wallace Hawks, 1236 Second Ave., Napa, CA (US) 94558

( * ) Notice: Subject to any disclaimer, the term of this patent is extended or adjusted under 35 U.S.C. 154(b) by 0 days.

(21) Appl. No.: 09/956,296

(22) Filed: Sep. 18, 2001

(51) Int. Cl.[7] ..... H01R 29/00
(52) U.S. Cl. ..... 439/172; 173/518; 173/53
(58) Field of Search ..... 439/502, 222, 439/217, 238, 172, 173, 518, 53, 166

(56) References Cited

U.S. PATENT DOCUMENTS 3,622,684 A * 11/1971 Press ..... 439/131
3,825,875 A * 7/1974 Garrett ..... 439/171
4,900,270 A * 2/1990 Edwards et al. ..... 439/173
4,904,195 A * 2/1990 Thackeray ..... 439/173
5,322,449 A * 6/1994 Pizano ..... 439/222
5,681,171 A * 10/1997 Park ..... 439/31
6,126,460 A * 10/2000 Wu ..... 439/172

* cited by examiner

*Primary Examiner*—Renee Luebke
*Assistant Examiner*—Briggitte R. Hammond
(74) *Attorney, Agent, or Firm*—Larry D. Johnson; Craig M. Stainbrook; Johnson & Stainbrook, LLP

(57) ABSTRACT

An electrical extension cord includes a male plug convertible between standard residential or blade-type plug elements and twist-lock blade elements, and a female receptacle plug designed to accommodate both standard and twist-lock male plugs. The male plug includes a pivoting body member having a twist-lock set of blade elements on one end, and a residential or blade-type set of plug elements on the other end, such that the user can selectively rotate the body member to orient the desired set of plug elements outwards for use. The selected set of plug elements are placed in electrical contact with the corresponding common, hot, and ground wires in the extension cord by releasable capture of the terminals of the wires, as by the use of spring contacts at the base of the plug elements. The inventive female plug accommodates both blade-type and twist-lock male plugs by providing fixed, permanent receiving slots for the plug elements of each type.

24 Claims, 8 Drawing Sheets

ELECTRICAL EXTENSION CORD WITH CONVERTIBLE PLUG AND ACCOMMODATING RECEPTACLE

BACKGROUND OF THE INVENTION

1. Field of the Invention

This invention relates generally to electrical cords and connectors, and more specifically to an improved electrical extension cord having a male plug convertible between standard residential or blade-type plug elements and twist-lock blade elements, and a female receptacle plug designed to accommodate both standard and twist-lock male plugs.

2. Description of the Prior Art

Electrical cords and connectors come in many sizes and configurations. For example, standard residential electrical systems typically utilize blade-type plugs and receptacles (NEMA 5–15). However, many power tools and accessories utilize twist-lock plugs and receptacles, chiefly in order achieve a more secure connection and to reduce disconnection in active use. This disparity in connector types can cause delay and frustration, because a user of twist-lock equipment and cords must use a blade-type adapter to connect to a residential outlet, and a user of blade-type equipment and cords must use a twist-lock adapter to connect to a twist-lock receptacle or cord. It can be both inconvenient and time-consuming to locate and connect such adapters.

It is accordingly an object of this invention to provide a single plug that will couple to either a residential or a locking-type connector or receptacle.

It is a further object of this invention to provide a self-contained plug that can be converted from a residential-type connector or receptacle to a locking-type connector or receptacle and back again.

It is a still further object of this invention to provide a single system for different electrical couplings that is convenient to use and that does not require additional attachments.

It is a still further object of this invention to provide an electrical receptacle or connector that will accept either an electrical locking plug or a residential plug without the use of an adapter.

SUMMARY OF THE INVENTION

The electrical extension cord with convertible plug and accommodating receptacle of this invention provides an improved electrical extension cord having a male plug convertible between standard residential or blade-type plug elements and twist-lock blade elements, and a female receptacle plug designed to accommodate both standard and twist-lock male plugs. The inventive male plug includes a pivoting body member having a twist-lock set of blade elements on one end, and a residential or blade-type set of plug elements on the other end, such that the user can selectively rotate the body member to orient the desired set of plug elements outwards for use. The selected set of plug elements are placed in electrical contact with the corresponding common, hot, and ground wires in the extension cord by releasable capture of the terminals of the wires, as by the use of spring contacts at the base of the plug elements. The inventive female plug accommodates both blade-type and twist-lock male plugs by providing fixed, permanent receiving slots for the plug elements of each type.

DETAILED DESCRIPTION OF A PREFERRED EMBODIMENT

Figure 1:
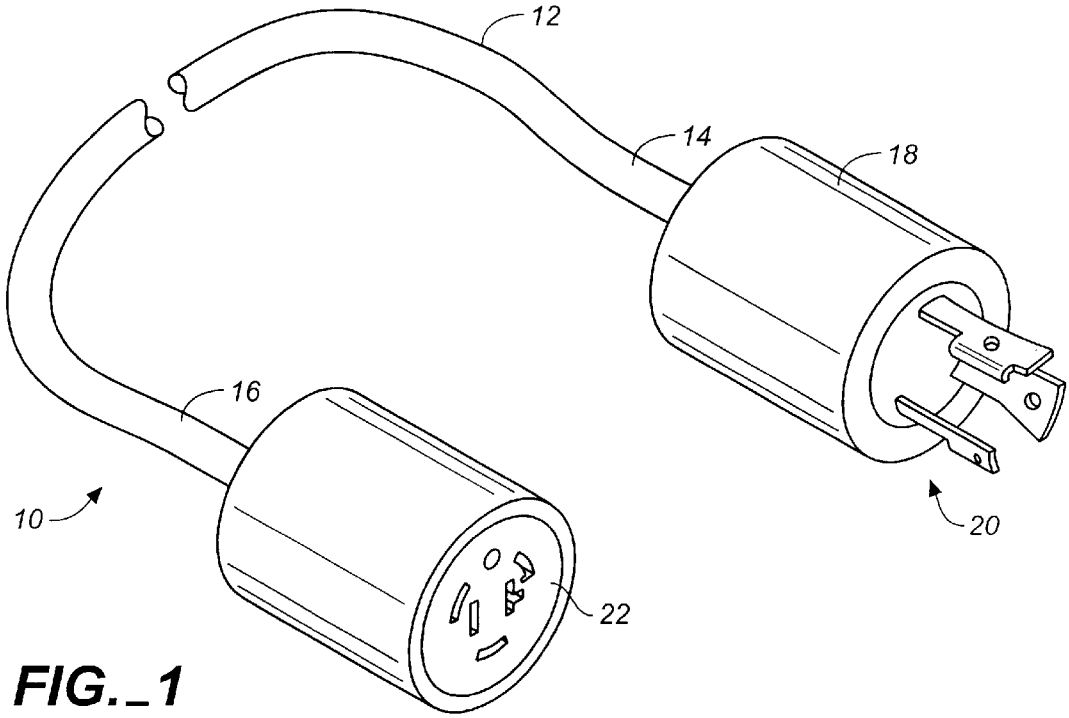
FIG. 1 is a perspective view of an electrical extension cord of this invention illustrating a male plug in its twist-lock plug configuration, and a universal blade-type/twist-lock accommodating female plug.

FIG. 1 is a perspective view of an electrical extension cord 10 of this invention illustrating a length of electrical cord 12 terminating in a pair of ends 14, 16. End 14 bears a male plug 18 shown here in its twist-lock plug configuration 20. End 16 bears a universal blade-type/twist-lock accommodating female plug 22.

Figure 2:
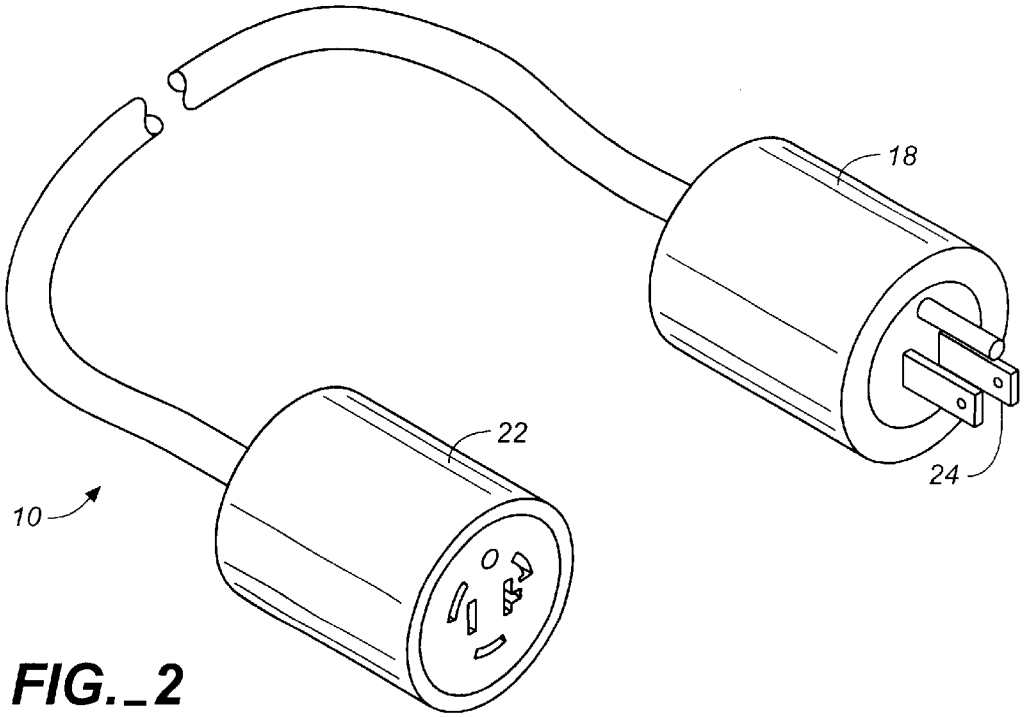
FIG. 2 is a perspective view of the electrical extension cord of FIG. 1 with the male plug now in its residential or blade-type plug configuration.

FIG. 2 is a perspective view of the electrical extension 10 cord of FIG. 1 with the male plug 18 now in its residential or blade-type plug configuration 24.

Figure 3:
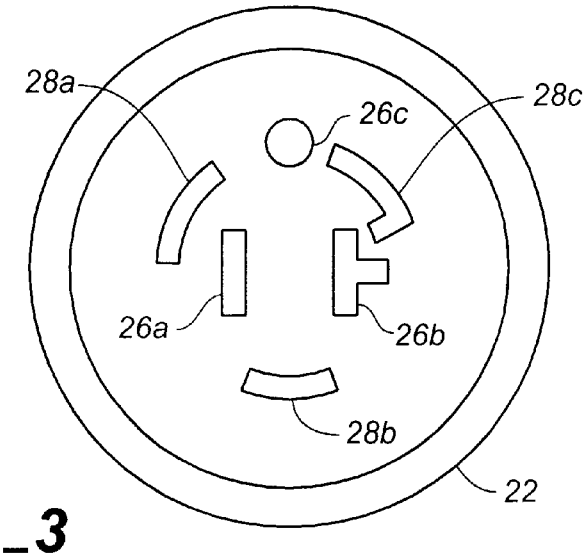
FIG. 3 is an end view of the universal blade-type/twist-lock accommodating female plug of FIG. 1.

FIG. 3 is an end view of the universal blade-type/twist-lock accommodating female plug 22. The inventive female plug accommodates both blade-type and twist-lock male plugs by providing fixed, permanent receiving slots for the plug elements of each type, e.g., slots 26*a, b*, and *c* for blade-type plugs, and slots 28*a, b*, and *c* for twist-lock plugs. As will be readily appreciated, slot 26*b* could be configured as only parallel to slot 26*a*, perpendicular only to slot 25*a*, or both parallel and perpendicular in combination, as shown in FIG. 3. These slots all are wired to the appropriate conductors within the plug 22, as is well known in the art.

Figure 4:
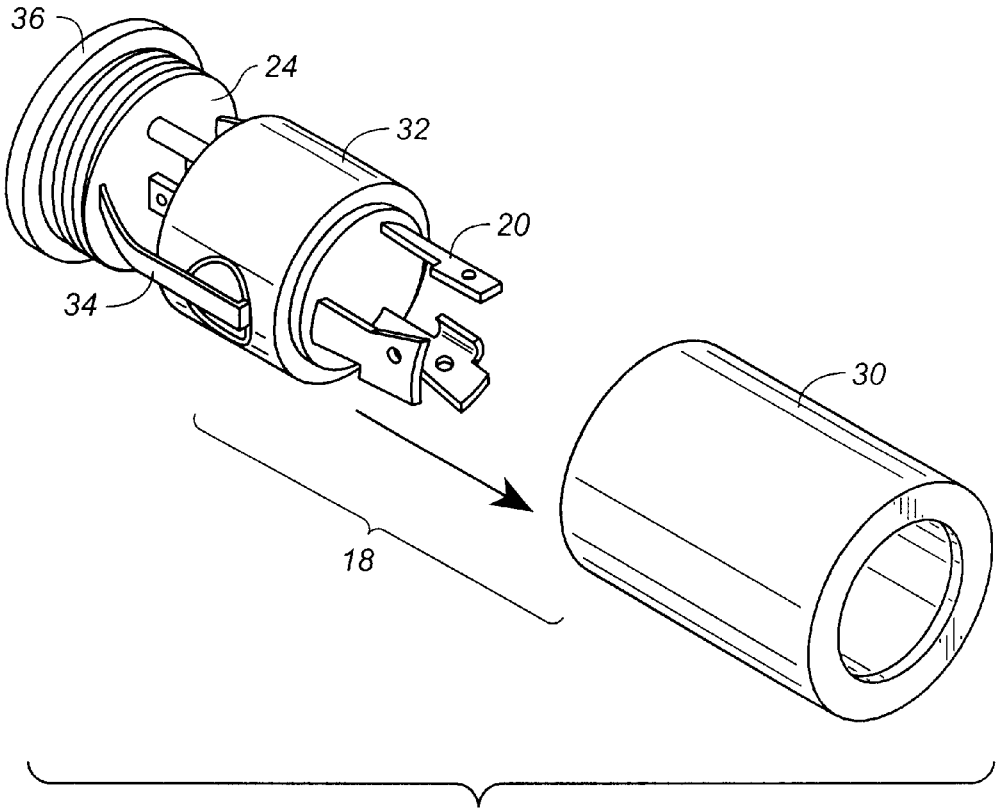
FIG. 4 is a perspective view of the male plug portion of the invention, illustrating the housing having been removed to reveal the pivoting body of the plug, and the twist-lock set of plug elements oriented outwards.

FIG. 4 is a perspective view of the male plug portion 18, illustrating a housing 30 having been removed to reveal a pivoting body 32 of the plug, with the twist-lock set of plug elements 20 oriented outwards. Body 32 pivots on supports 34 extending from threaded base 36. The threaded base shown is illustrative of one of a number of means for securing housing to the base, including, for example, tension fit, spring clips, spring-biased nipple and hole elements, bayonet coupling, and so forth.

Figure 5:
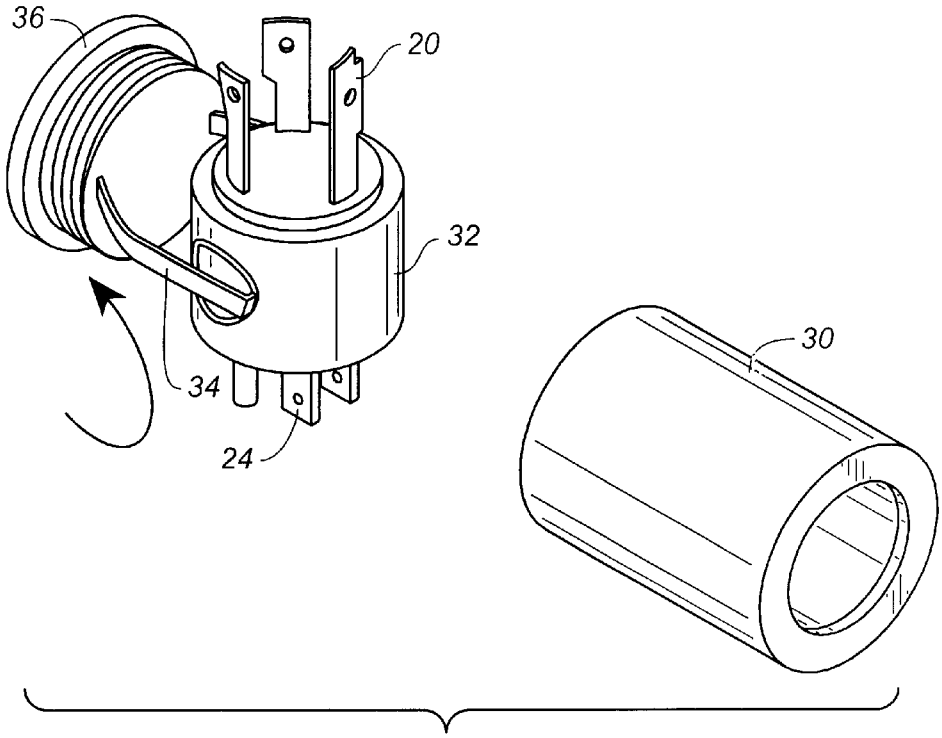
FIG. 5 is a perspective view of the body of the plug being pivoted to rotate the twist-lock set of plug elements inwards and the blade-type set of plug elements outwards.

FIG. 5 is a perspective view of the pivoting body 32 being pivoted to rotate the twist-lock set of plug elements 20 inwards and the blade-type set of plug elements 24 outwards.

Figure 6:
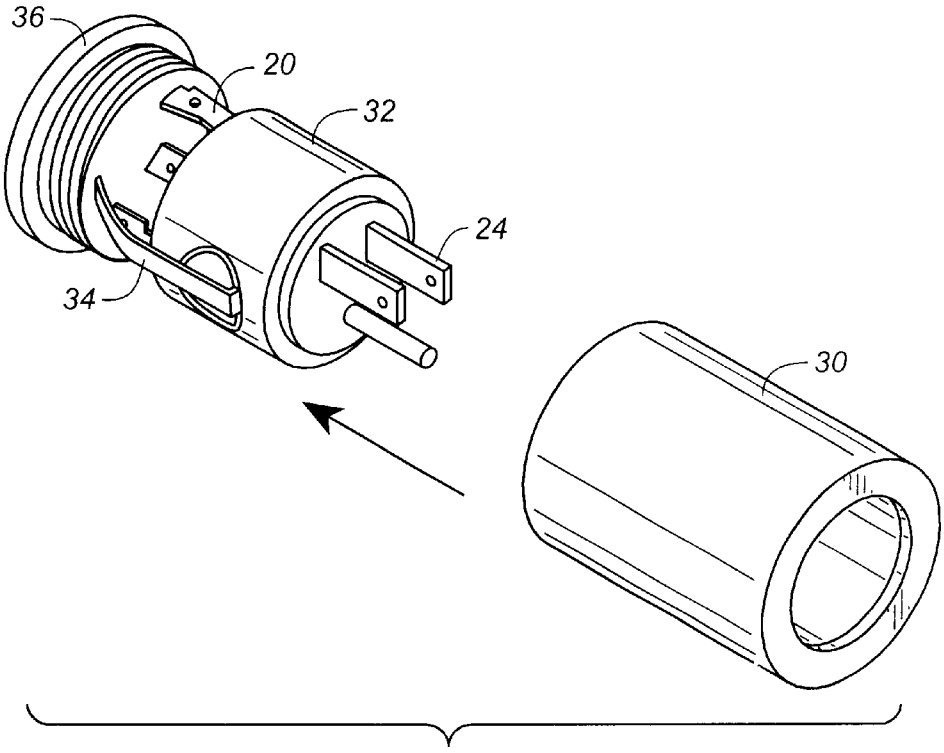
FIG. 6 is a perspective view of the body of the plug having been rotated 180 degrees to orient the blade-type set of plug elements outwards.

FIG. 6 is a perspective view of the body 32 having been rotated 180 degrees to orient the blade-type set of plug elements 24 outwards.

Figure 7:
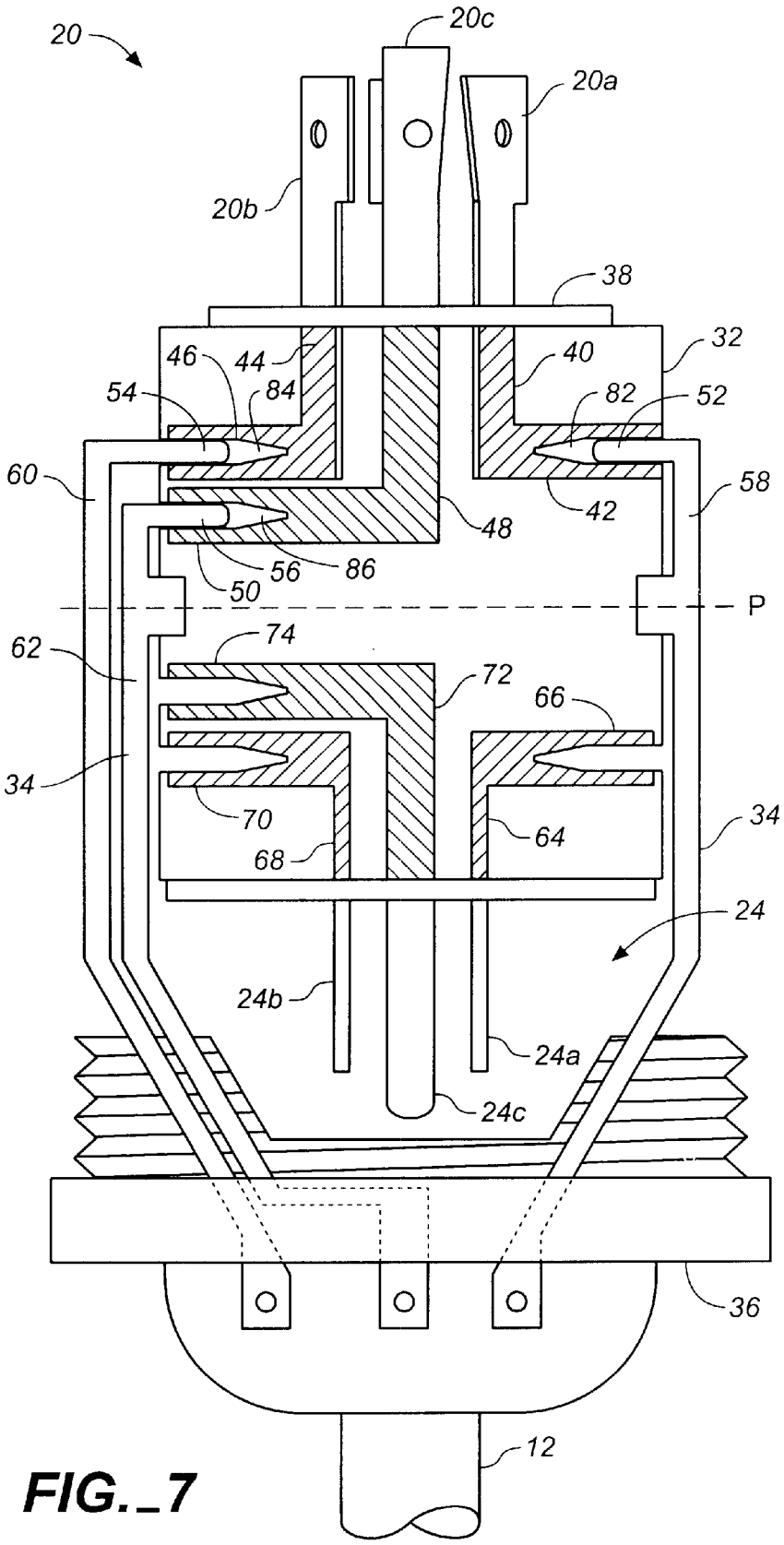
FIG. 7 is a side elevation cross-sectional view of a first embodiment of the male plug portion of the invention, illustrating selectively pivoting connections for the common, hot, and ground terminals.

FIG. 7 is a side elevation cross-sectional view of a first embodiment of the male plug portion 18 of the invention. As described supra, pivoting body 32 pivots on supports 34 extending from threaded base 36. Pivoting body 32 bears a twist-lock set of blade elements 20 on one end 38. These blade elements include hot or line prong 20*a*, common or neutral prong 20*b*, and ground prong 20*c*. Line prong 20*a* extends into body 32 as conductor 40, and terminates in squeeze fingers or spring contacts 42. Common prong 20*b* extends into body 32 as conductor 44, and terminates in squeeze fingers or spring contacts 46. Ground prong 20*c* extends into body 32 as conductor 48, and terminates in squeeze fingers or spring contacts 50. Each of these contacts releasably captures the terminal of the corresponding conductor when it is rotated into position. For example, hot or line contacts 42 capture hot terminal 52; common or neutral contacts 46 capture common terminal 54; and ground contacts 50 capture ground terminal 56. Each of these terminals is connected to the corresponding wire in cord 12 by the corresponding conductor, i.e., hot terminal 52 communicates via conductor 58, common terminal 54 communicates via conductor 60, and ground terminal 56 communicates via ground conductor 62. Conductors 58 and 62 are preferably routed through supports 34. Conductors 58, 60, and 62 may be covered with non-conductive material.

As is well known in the art, the blade-type and twist-lock elements may be of several types, adapted for use with appropriate receptacles, for example NEMA 10–30R, or NEMA 10–50R. The elements shown in the drawings are thus illustrative of the general principle that alternative blade types and configurations may be positioned at either end of the pivoting body 32 of the male plug.

A residential or blade-type set of plug elements 24 is positioned on the other end of pivoting body 32 opposite the locking-type set of elements 20. These blade elements include hot or line blade 24*a*, common or neutral blade 24*b*, and ground element 24*c*. Hot blade 24*a* and common blade 24*b* may be either parallel or perpendicular to one another, as is well known, and each configuration is accommodated by the configuration of female plug slots 26*a, b* (FIG. 3). Line blade 24*a* extends into body 32 as conductor 64, and terminates in squeeze fingers or spring contacts 66. Common blade 24*b* extends into body 32 as conductor 68, and terminates in squeeze fingers or spring contacts 70. Ground element 24*c* extends into body 32 as conductor 72, and terminates in squeeze fingers or spring contacts 74. As above, each of these contacts releasably captures the terminal of the corresponding conductor when it is rotated into position. For example, hot or line contacts 66 capture hot terminal 52, common or neutral contacts 70 capture common terminal 54, and ground contacts 74 capture ground terminal 56. Again, as will be readily appreciated by those having skill in the art, spring contacts 66, 70, and 74 are fungible with a number of other suitable means for making temporary selective electrical contact with the terminals of the various conductors without violating the principle of operation of the present invention.

Pivoting body 32 rotates about pivot axis P to position the desired set of contacts (either the twist-lock set of contacts 42, 46, 50, or the blade-type set of contacts 66, 70, 74) into alignment to capture the terminals 52, 54, 56. Thus, the selected set of plug elements are energized by connection to the appropriate conductors, and the deselected set is isolated. Terminals 52, 54, and 56 extend into pivoting body 32 by means of slots 82, 84, and 86 (shown in more detail in FIG. 11).

Figure 8:
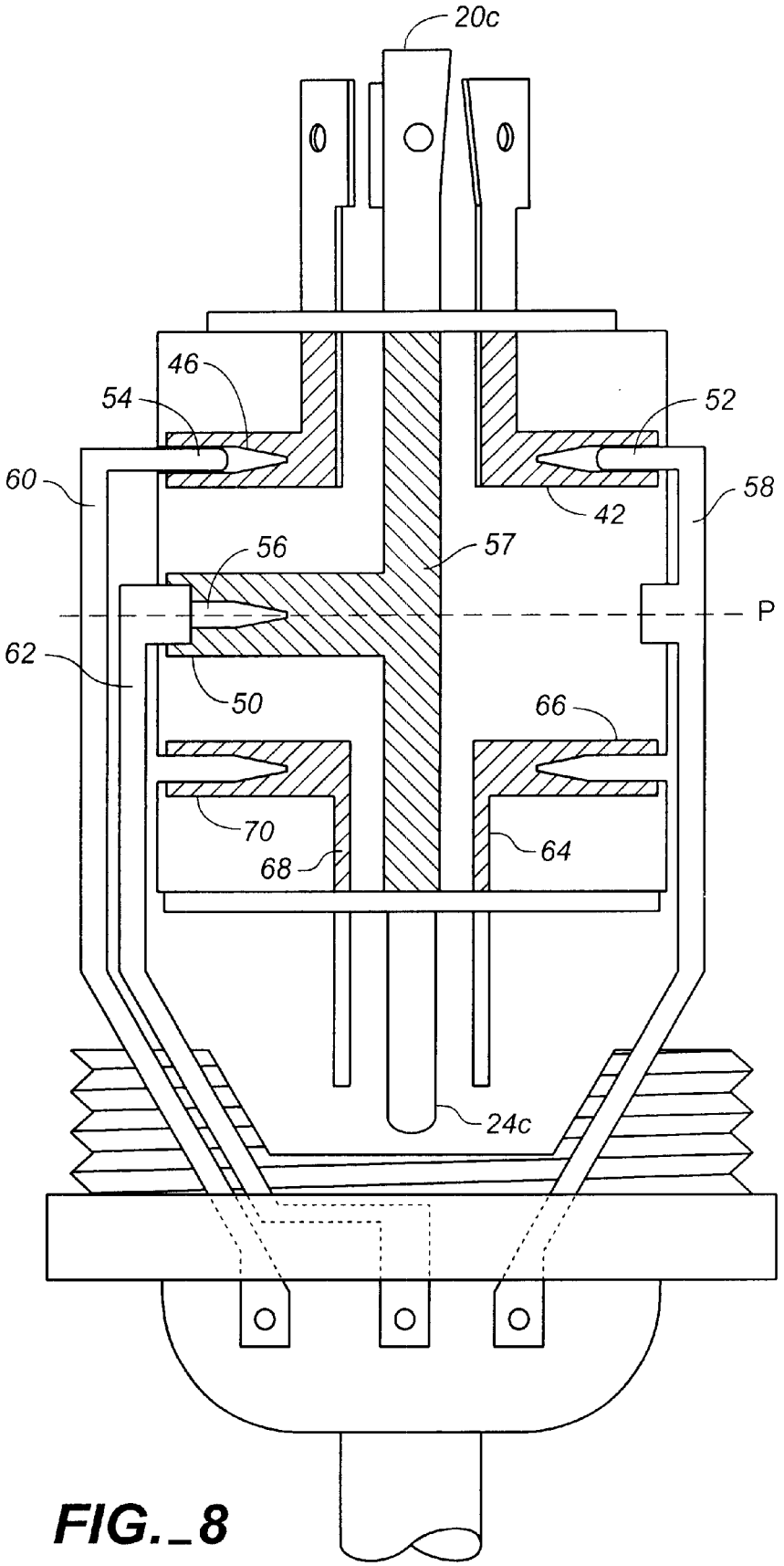
FIG. 8 is a side elevation cross-sectional view of a second embodiment of the male plug portion, having selectively pivoting contacts for the common and hot terminals only, with the ground terminal constantly connected at the central pivot axis.

FIG. 8 is a side elevation cross-sectional view of a second embodiment of the male plug portion, having selectively pivoting contacts for the common and hot terminals only, 54 and 52 respectively, with the ground terminal 56 constantly connected at the central pivot axis P to a ground conductor 57 common to both the ground prong 20*c* of the twist-lock configuration and the ground element 24*c* of the residential configuration.

Figure 9:
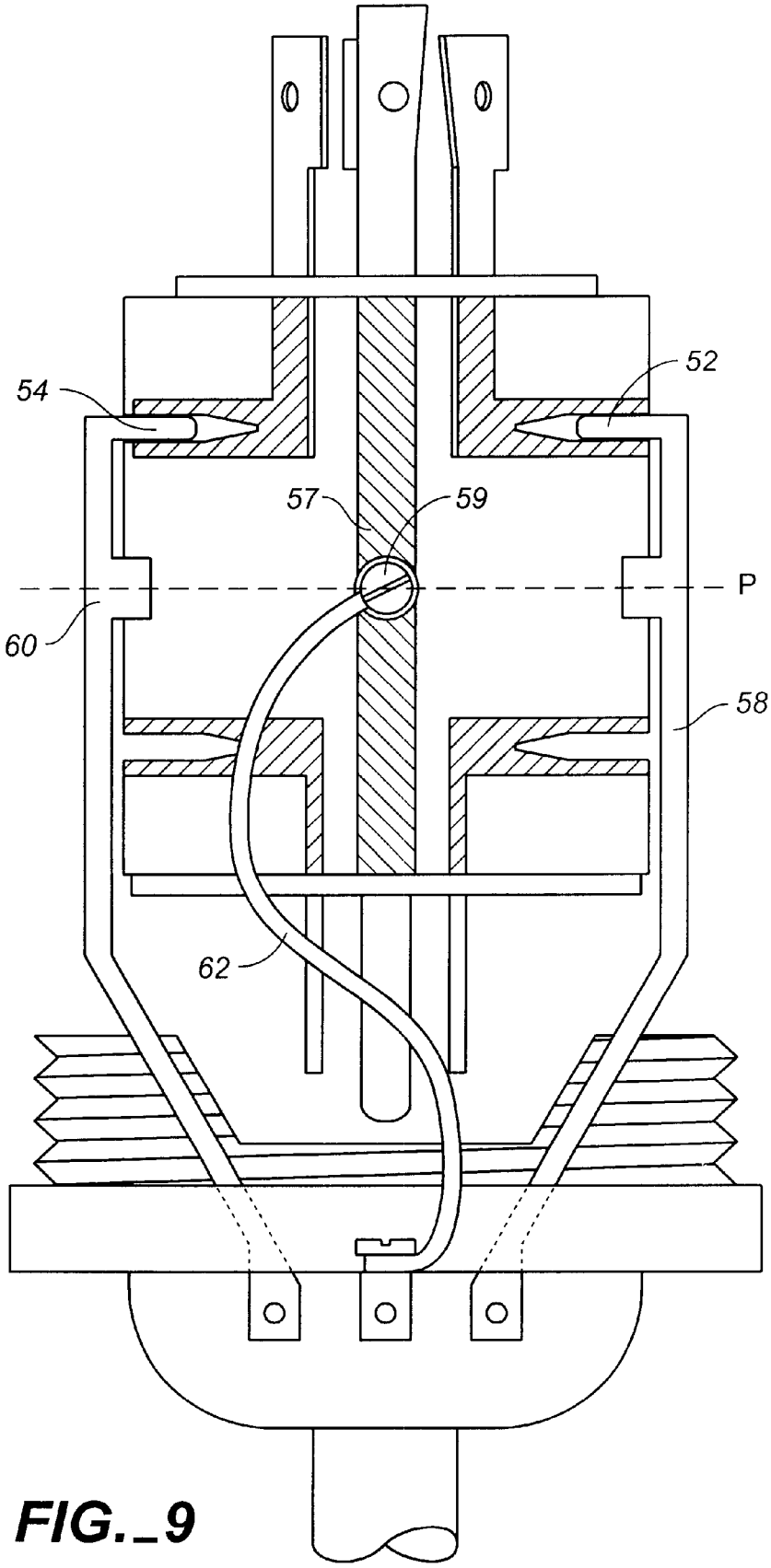
FIG. 9 is a side elevation cross-sectional view of a third embodiment of the male plug portion, having selectively pivoting contacts for the common and hot terminals only, with the ground terminal hard wired to the ground elements of both plug sets.

FIG. 9 is a side elevation cross-sectional view of a third embodiment of the male plug portion, having selectively pivoting contacts for the common and hot terminals only, 54 and 52 respectively, with an insulated ground terminal 62 hard wired to the common conductor 57 for the ground elements of both plug sets. Ground terminal 62 must be removed at connector 59 before the pivoting body 32 of the male plug can be swivelled to change plug sets.

Figure 10:
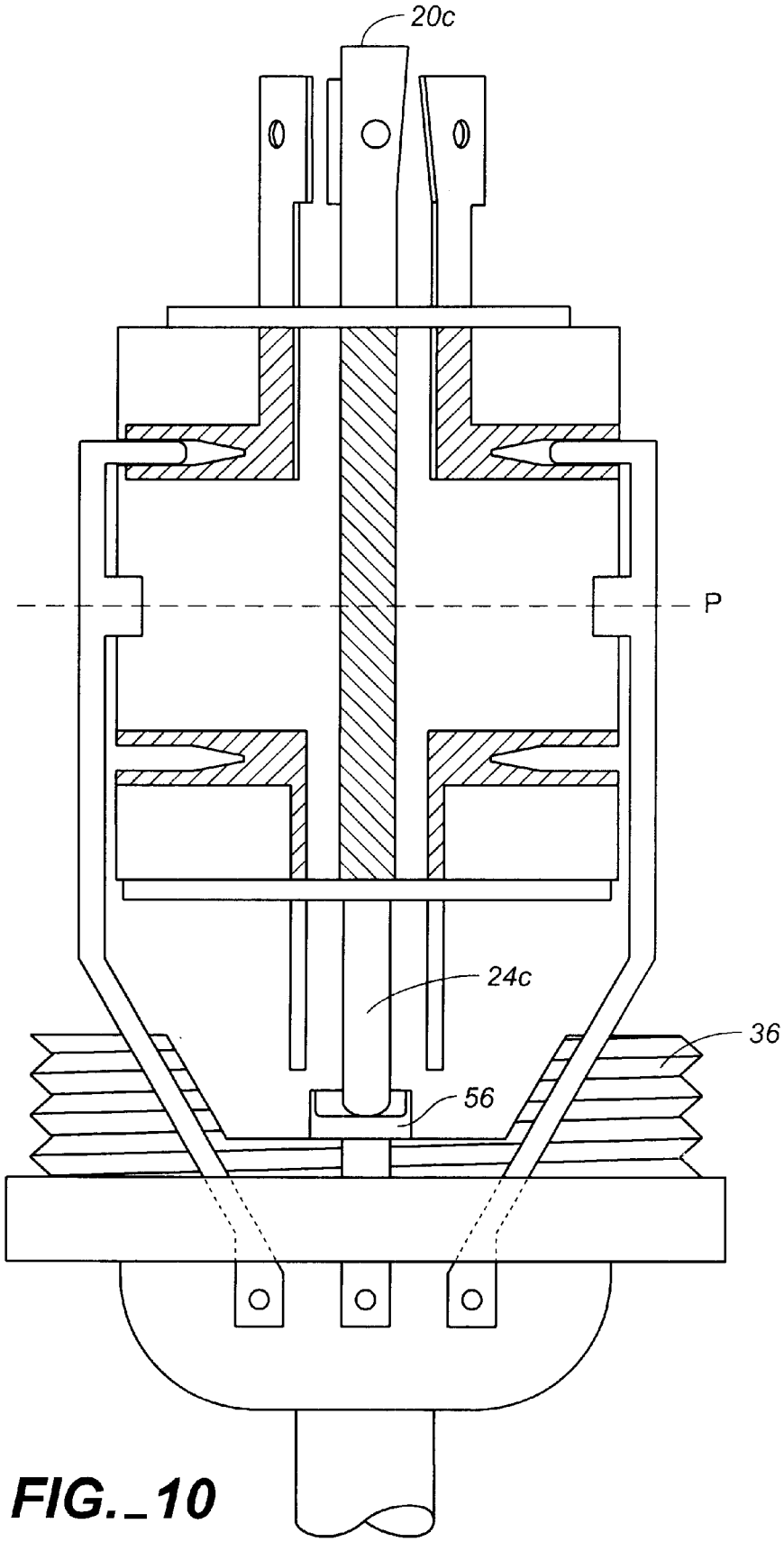
FIG. 10 is a side elevation cross-sectional view of a fourth embodiment of the male plug portion, having selectively pivoting contacts for all terminals, but wherein the ground contact is embedded in the base.

FIG. 10 is a side elevation cross-sectional view of a fourth preferred embodiment of the male plug portion, having selectively pivoting contacts for all terminals, but wherein the ground terminal 56 is positioned in the base 36 so as to capture either ground prong 20*c* and ground element 24 when pivoting body 32 is fully swivelled about pivot axis P.

Figure 11:
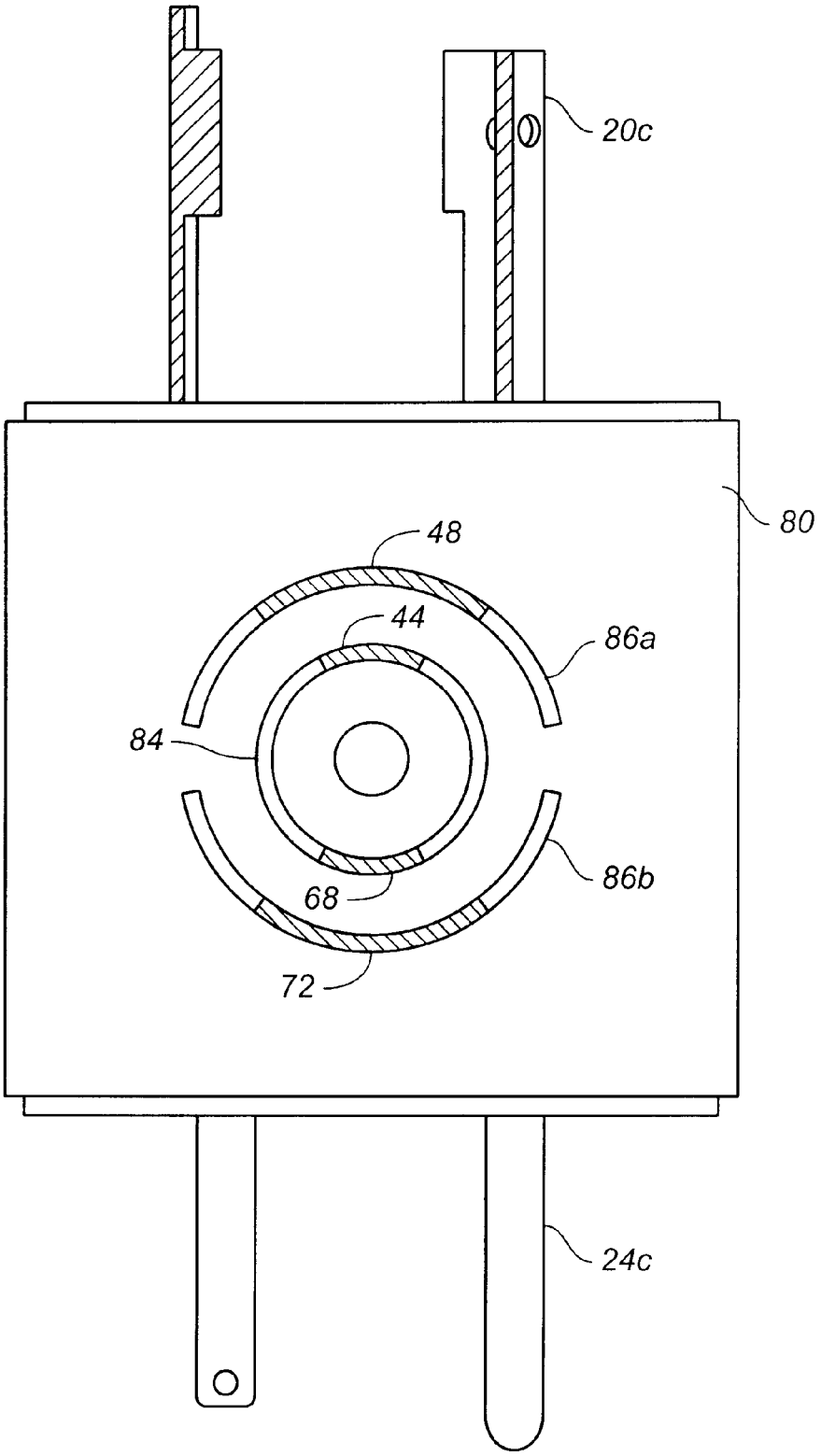
FIG. 11 is a side view in elevation showing detail of the pivoting portion of the male plug, particularly illustrating the open slots on the exterior of the pivoting portion that permit the conductors to extend into the body to make electrical contact with the terminals.

FIG. 11 is a side view in elevation showing detail of the exterior portion 80 of pivoting body 32 of the male plug, particularly illustrating the open slots on the exterior of the pivoting portion that permit the conductors to extend into the body to make electrical contact with the terminals. This view shows the side of the pivoting body is adapted with slots ground terminal slots 86*a, b*, and a common terminal slot 84 for insertion of the ground and common terminals 56 and 54 respectively, as shown in FIG. 7. Ground conductors 48, 72, are shown through slots 86*a* and 86*b*, and common conductors 44, 68 are shown through slot 84. It will be readily appreciated that on the opposite side of the pivoting body, a single slot permits the insertion of the hot terminal through the side of the pivoting body. Accordingly, the pivoting body is allowed to swivel about axis point P in selectively bringing the terminals into contact with the conductors of either the blades or prongs of the plug.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. An electrical extension cord, comprising:

a length of electrical cord terminating in a pair of ends;

a male plug member connected to one of said ends of said electrical cord, said male plug member including a base and a pivoting body member, said pivoting body member having a first end having a twist-lock set of plug elements and a second end having blade-type set of plug elements; and first and second supports extending from said base and defining a pivot axis about which said pivoting body member may be selectively rotated substantially 180 degrees to orient a desired set of plug elements outward for use.

2. The electrical extension cord of claim 1, further including a hot terminal, a ground terminal, and a neutral terminal disposed through said pivoting body, and wherein each of said twist-lock set of plug elements and blade-type plug elements includes a hot prong, a neutral prong, and a ground prong, and wherein each of said hot prongs and neutral prongs extend into said pivoting body as a conductor and terminate in an electrically conductive selectively pivoting contact within said pivoting body; and wherein said electrically conductive selectively pivoting contacts of one set of said plug elements releasably captures the terminal of the corresponding conductor when said pivoting body is rotated into position; and wherein said ground prongs of each of said set of plug elements extend into said pivoting body as a shared conductor common to both the ground prong of said twist-lock set of plug elements and said ground prong of said blade-type set of plug elements, and wherein said shared conductor is constantly connected at said central pivot axis to said ground conductor.

3. The electrical extension cord of claim 1, further including a hot terminal and a neutral terminal disposed through said pivoting body, and an insulated ground terminal; wherein each of said twist-lock set of plug elements and blade-type plug elements includes a hot prong, a neutral prong, and a ground prong; wherein each of said hot prongs and neutral prongs extend into said pivoting body as a conductor and terminate in an electrically conductive selectively pivoting contact within said pivoting body; wherein said electrically conductive selectively pivoting contacts of one set of said plug elements releasably captures the terminal of the corresponding conductor when said pivoting body is rotated into position; wherein said ground prongs of each of said sets of plug elements extends into said pivoting body as a shared conductor common to both the ground prong of said twist-lock set of plug elements and said ground prong of said blade-type set of plug elements; and wherein said insulated ground terminal is hard wired to said shared conductor.

4. The electrical extension cord of claim 1, further including a hot terminal and a neutral terminal disposed through said pivoting body, and a ground terminal positioned in said base; and wherein each of said twist-lock set of plug elements and blade-type plug elements includes a hot prong, a neutral prong, and a ground prong, and wherein each of said hot prongs and neutral prongs extend into said pivoting body as a conductor and terminate in an electrically conductive selectively pivoting contact within said pivoting body; and wherein said electrically conductive selectively pivoting contacts of one set of said plug elements releasably captures the terminal of the corresponding conductor when said pivoting body is rotated into position; and wherein said ground prongs of each of said set of plug elements extend into said pivoting body as a shared conductor common to both the ground prong of said twist-lock set of plug elements and said ground prong of said blade-type set of plug elements, and wherein said ground terminal captures either of said ground prong or ground element when said pivoting body is fully rotated about said pivot axis.

5. The electrical extension cord of claim 1, further including a universal blade-type/twist-lock female plug connected to one of said ends of said electrical cord, said female plug having fixed, permanent receiving slots for accommodating both blade-type and twist-lock male plugs.

6. The electrical extension cord of claim 5, wherein said female plug includes slots for blade-type plugs and slots for twist-lock plugs, wherein each of said slots are wired to conductors within the plug.

7. The electrical extension cord of claim 1, further including:

a housing for covering said pivoting body member;

attachment means for removably securing said housing to said base.

8. The electrical extension cord of claim 7, wherein said attachment means is selected from the group consisting of tension fit elements, spring clips, spring-biased nipple and hole elements, bayonet coupling, and complementary male and female threads.

9. The electrical extension cord of claim 1, further including a hot terminal, a ground terminal, and a neutral terminal disposed through said pivoting body, and wherein each of said twist-lock set of plug elements and blade-type plug elements includes a hot prong, a neutral prong, and a ground prong, and wherein each of said hot prongs, neutral prongs, and ground prongs extend into said pivoting body as a conductor and terminate in an electrically conductive selectively pivoting contact within said pivoting body; wherein said electrically conductive selectively pivoting contacts of one set of said plug elements releasably captures a terminal of a corresponding conductor when said pivoting body is rotated into position.

10. The electrical extension cord of claim 9, wherein said electrically conductive contacts comprise squeeze fingers.

11. The electrical extension cord of claim 9, wherein said electrically conductive contacts comprise spring contacts.

12. The electrical extension cord of claim 9, wherein each of said hot, neutral, and ground terminals is connected to respective hot, neutral and ground wires in said cord by a corresponding hot, neutral, and ground conductor.

13. The electrical extension cord of claim 12, wherein said hot and neutral conductors are routed through said first and said second supports.

14. The electrical extension cord of claim 12, wherein said first and second supports are said hot and said neutral conductors, respectively.

15. A male plug member adapted for connection to an electrical extension cord, said male plug member comprising:

a base and a pivoting body member having a first end having a twist-lock set of plug elements and a second end having blade-type set of plug elements; and first and second supports extending from said base and defining a pivot axis about which said pivoting body member may be selectively rotated substantially 180 degrees to orient a desired set of plug elements outward for use.

16. The male plug member of claim 15, further including a hot terminal, a ground terminal, and a neutral terminal disposed through said pivoting body, and wherein each of said twist-lock set of plug elements and blade-type plug elements includes a hot prong, a neutral prong, and a ground prong, and wherein each of said hot prongs and neutral prongs extend into said pivoting body as a conductor and terminate in an electrically conductive selectively pivoting contact within said pivoting body; and wherein said electrically conductive selectively pivoting contacts of one set of said plug elements releasably captures the terminal of the corresponding conductor when said pivoting body is rotated into position; and wherein said ground prongs of each of said set of plug elements extend into said pivoting body as a shared conductor common to both the ground prong of said twist-lock set of plug elements and said ground prong of said blade-type set of plug elements, and wherein said shared conductor is constantly connected at said central pivot axis to said ground conductor.

17. The male plug member of claim 15, further including a hot terminal and a neutral terminal disposed through said pivoting body, and an insulated ground terminal; wherein each of said twist-lock set of plug elements and blade-type plug elements includes a hot prong, a neutral prong, and a ground prong; wherein each of said hot prongs and neutral prongs extend into said pivoting body as a conductor and terminate in an electrically conductive selectively pivoting contact within said pivoting body; wherein said electrically conductive selectively pivoting contacts of one set of said plug elements releasably captures the terminal of the corresponding conductor when said pivoting body is rotated into position; wherein said ground prongs of each of said sets of plug elements extends into said pivoting body as a shared conductor common to both the ground prong of said twist-lock set of plug elements and said ground prong of said blade-type set of plug elements; and wherein said insulated ground terminal is hard wired to said shared conductor.

18. The male plug member of claim 15, further including a hot terminal and a neutral terminal disposed through said pivoting body, and a ground terminal positioned in said base; and wherein each of said twist-lock set of plug elements and blade-type plug elements includes a hot prong, a neutral prong, and a ground prong, and wherein each of said hot prongs and neutral prongs extend into said pivoting body as a conductor and terminate in an electrically conductive selectively pivoting contact within said pivoting body; and wherein said electrically conductive selectively pivoting contacts of one set of said plug elements releasably captures the terminal of the corresponding conductor when said pivoting body is rotated into position; and wherein said ground prongs of each of said set of plug elements extend into said pivoting body as a shared conductor common to both the ground prong of said twist-lock set of plug elements and said ground prong of said blade-type set of plug elements, and wherein said ground terminal captures either of said ground prong or ground element when said pivoting body is fully rotated about said pivot axis.

19. The male plug member of claim 15, further including:

a housing for covering said pivoting body member;

attachment means for removably securing said housing to said base.

20. The male plug member of claim 19, wherein said attachment means is selected from the group consisting of tension fit elements, spring clips, spring-biased nipple and hole elements, bayonet coupling, and complementary male and female threads.

21. The male plug member of claim 15, further including a hot terminal, a ground terminal, and a neutral terminal disposed through said pivoting body, and wherein each of said twist-lock set of plug elements and blade-type plug elements includes a hot prong, a neutral prong, and a ground prong, and wherein each of said hot prongs, neutral prongs, and ground prongs extend into said pivoting body as a conductor and terminate in an electrically conductive selectively pivoting contact within said pivoting body; wherein said electrically conductive selectively pivoting contacts of one set of said plug elements releasably captures a terminal of a corresponding conductor when said pivoting body is rotated into position.

22. The male plug member of claim 21, wherein said electrically conductive contacts comprise squeeze fingers.

23. The male plug member of claim 21, wherein said electrically conductive contacts comprise spring contacts.

24. The male plug member of claim 21, wherein each of said hot, neutral, and ground terminals is connected to respective hot, neutral and ground wires in said cord by a corresponding hot, neutral, and ground conductor.

* * * * *